United States Patent [19]

Martin et al.

[11] Patent Number: 4,465,429

[45] Date of Patent: Aug. 14, 1984

[54] STEAM TURBINE WITH SUPERHEATED BLADE DISC CAVITIES

[75] Inventors: Harry F. Martin, Upper Providence; Martin E. Schlatter, Glen Mills, both of Pa.

[73] Assignee: Westinghouse Electric Corp., Pittsburgh, Pa.

[21] Appl. No.: 344,330

[22] Filed: Feb. 1, 1982

[51] Int. Cl.[3] ..... F01D 5/14

[52] U.S. Cl. ..... 415/116; 415/115; 415/170 R; 415/176; 415/178; 415/182; 415/110

[58] Field of Search ..... 415/115, 116, 170 R, 415/175, 176, 179, 182, 183, 110, 117, 95

[56] References Cited

U.S. PATENT DOCUMENTS

| | | | |
|---|---|---|---|
| 2,297,853 | 10/1942 | Zetterquist | 415/176 |
| 2,487,514 | 11/1949 | Boestad et al. | 415/115 |
| 2,584,899 | 2/1952 | McLeod | 415/116 |
| 2,618,461 | 11/1952 | Frankel et al. | 415/178 |
| 2,625,013 | 1/1953 | Howard et al. | 415/116 |
| 2,648,519 | 8/1953 | Campini | 415/116 |
| 3,291,447 | 12/1966 | Brandon | 415/176 |
| 3,756,740 | 9/1973 | Deich et al. | 415/170 R |

FOREIGN PATENT DOCUMENTS

| | | | |
|---|---|---|---|
| 350836 | 1/1961 | Switzerland | 416/95 |

*Primary Examiner*—John W. Shepperd
*Assistant Examiner*—John Kwon
*Attorney, Agent, or Firm*—F. J. Baehr, Jr.

[57] ABSTRACT

Several means for providing superheated steam varying in pressure and temperature in a plurality of cavities serially disposed between blade discs of a steam turbine in which steam flows from a high pressure to a low pressure portion and improved seals disposed at the radially outer periphery of the cavities which cooperate with the means for providing superheated steam in the cavities to eliminate moisture in the cavities and eliminate stress corrosion in the blade discs.

10 Claims, 9 Drawing Figures

STEAM TURBINE WITH SUPERHEATED BLADE DISC CAVITIES

CROSS-REFERENCE TO RELATED APPLICATION

An application entitled "Turbine Disc Environment Control System" filed Aug. 11, 1981 and assigned Ser. No. 291,744 is closely related to this application.

BACKGROUND OF THE INVENTION

This invention relates to steam turbines and more particularly to low pressure portions of the steam turbine which have blade discs shrunk on a shaft.

The low pressure stages of steam turbines operate in a wet steam environment and because of the large size of the present day turbines are manufactured with blade discs shrunk on a shaft because the diameter of the rotors are large and they cannot be forged in one piece by present day technology. The high stresses in the discs combined with wet steam enhance the probability of stress corrosion, which may result in cracking of the disc initiating at the bore.

SUMMARY OF THE INVENTION

In general, a steam turbine, when made in accordance with this invention, comprises a plurality of blade discs with a cavity between adjacent discs to form a plurality of cavities disposed serially with respect to steam flow from a high pressure to a low pressure portion of the turbine, means for providing superheated steam in said cavities, and low leakage seals between adjacent discs at a radially outward portion of said cavities.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENTS

Figure 1:
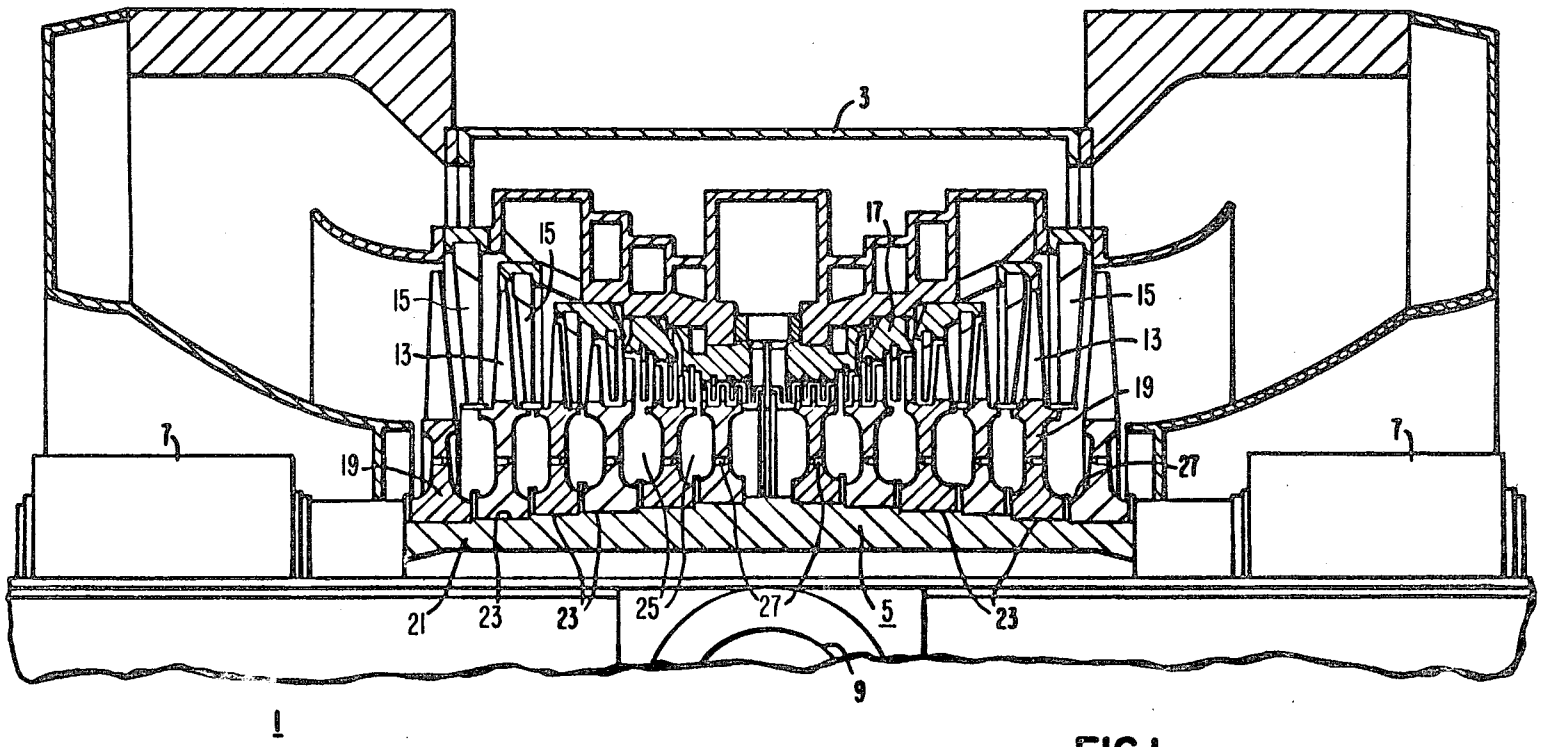
FIG. 1 is a partial sectional view of a steam turbine with blade discs and cavities disposed therebetween.

Referring now to the drawings in detail and in particular to FIG. 1 there is shown a portion of a low pressure turbine 1, which comprises an enclosed housing or casing 3 with a rotor 5 rotatably disposed therein. The casing 3 has journalled bearings 7 disposed on opposite ends for rotatably supporting the rotor 5 within the casing 3. A steam inlet nozzle 9 is disposed in the central portion of the casing 3 to supply steam to circular arrays of rotating and stationary blades 13 and 15, respectively. The stationary blades 15 are disposed in blade rings or diaphragms 17 which attach to the casing 3 and the rotating blades 13 are attached to blade disc 19, which may accommodate one or more circular arrays of rotating blades 13. The blade discs 19 are shrunk on a stepped shaft 21 having a plurality of steps 23 which ascend from each end thereof. Adjacent discs 19 are assembled on the shaft 21 to form a series of cavities 25. Steam enters the turbine 1 via the inlet nozzle 9 and flows from the central high pressure portion of the turbine 1 outwardly to the low pressure end portions of the turbine.

Figure 2:
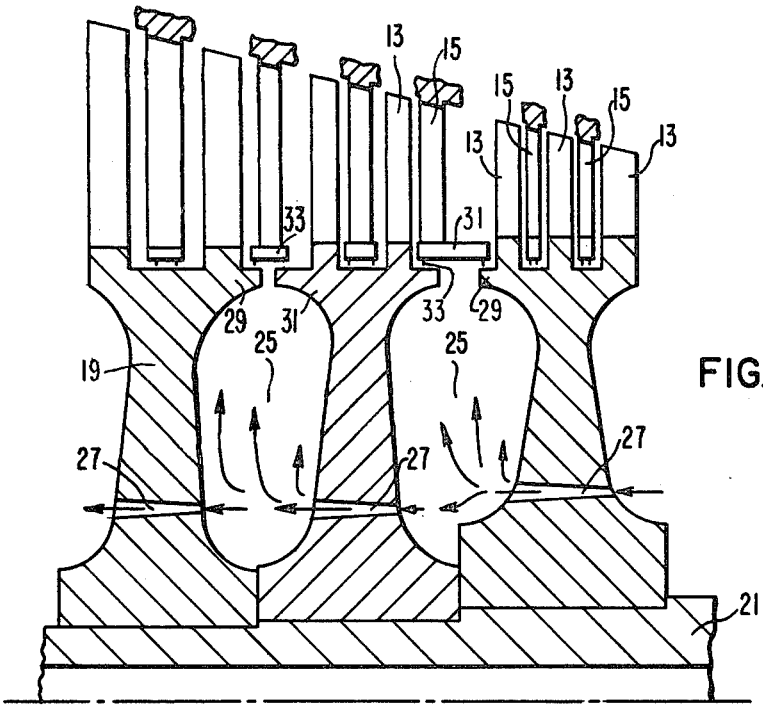
FIG. 2 is an enlarged partial sectional view of two blade disc cavities showing the invention.

As shown in FIG. 2, the discs 19 have a plurality of holes 27 disposed therein radially outwardly from the shaft 21. The holes 27 are in fluid communication with inlet steam and supply superheated steam serially to the cavities 25 serially disposed with respect to the steam flowing through the blades 13 and 15 from a high pressure portion of the turbine 1 to a low pressure portion of the turbine 1. The pressure in each serially disposed cavity 25 decreases, reducing the temperature of the steam serially within the cavities 25, but allows steam to remain in a superheated stae in each cavity 25.

To assist in maintaining the superheated condition in the serially cooler cavities 25, improved sealing is provided at the radially outer portion of the cavities 25 by providing axially disposed lands 29 and 31, respectively, on the blade discs 19 and blade diaphragms 17. The lands 29 and 31 cooperate with labyrinth seals 33 to seal the cavities 25 from the motive steam flowing through the blades 13 and 15 and maintain the superheated condition of the steam in the serially disposed cavities 25.

Throttling across the holes 27 reduces the pressure in the serially disposed cavities 25 to cooperate with the improved seals to maintain steam in a superheated condition in each of the cavities 25.

Figure 3:
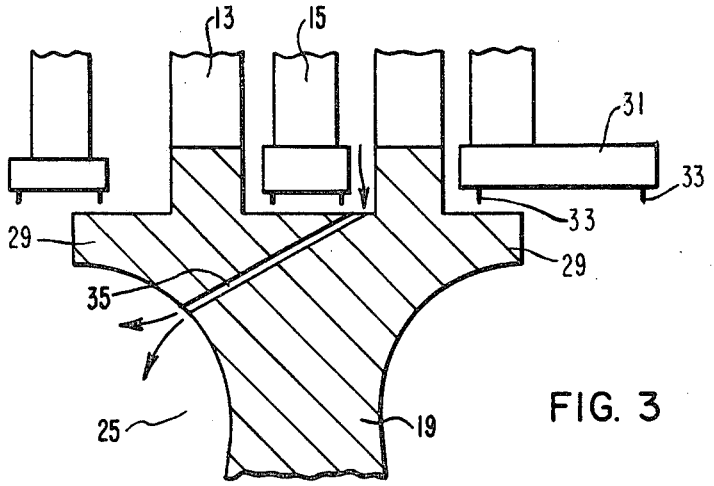
FIG. 3 is an enlarged partial sectional view of cavities between blade views showing an alternate embodiment of this invention.

FIG. 3 shows a duct 35 in the radially outward portion of the blade disc 19 disposed to supply motive steam to the cavities 25 from stages upstream of the serially disposed cavities 25.

Figure 4:
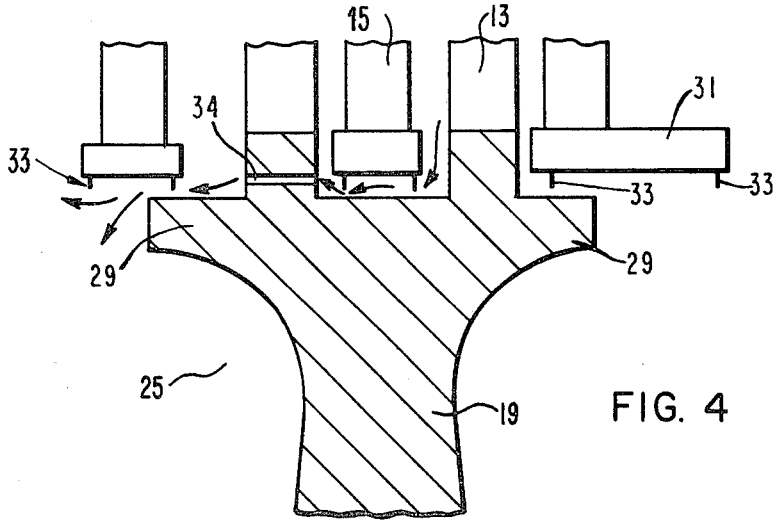
FIG. 4 is an enlarged partial sectional view of cavities between blade discs showing an alternate embodiment.

FIG. 4 shows a duct 34 in the blade root portions of the discs 19 to supply motive steam to the cavities 25 from upstream portion of the turbine to provide steam in a superheated condition to the cavities 25 via the duct 34 and the added clearance in the seal between the stationary blade diaphragm and the blade disc.

Figure 5:
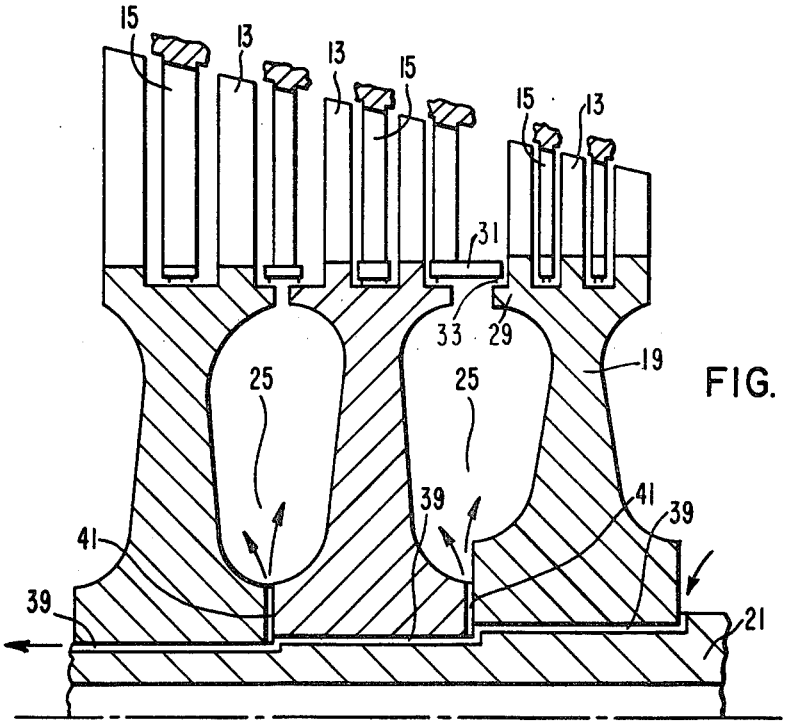
FIGS. 5–9 are enlarged partial sectional views of two blades disc cavities showing alternative embodiments of this invention.

FIG. 5 shows a plurality of axially disposed grooves 39 in the shaft in fluid communication with radially disposed passages 41 in the blade disc. The grooves 39 and passages 41 are in fluid communication with a supply of inlet steam to supply superheated steam to the cavities 25. The amount of steam flowing to the serially disposed cavites 25 is varied to provide the proper temperature and pressure in each cavity 25 to maintain a superheated steam condition in each of the serially disposed cavities 25. In addition, improved sealing of the cavities 25 is also utilized to control the temperature and pressure gradients in the cavities 25.

Figure 6:
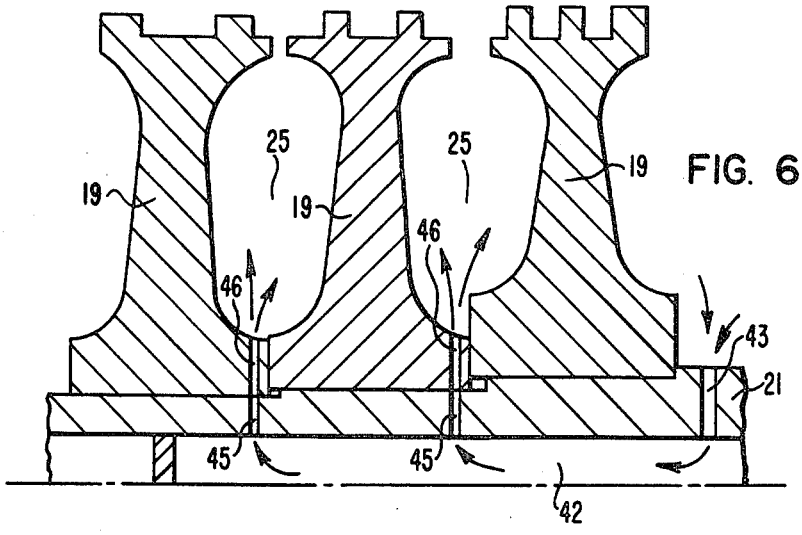

FIG. 6 shows the shaft 21 has a central bore 42 and an inlet duct 43 which supplies inlet steam to the bore 42 and a plurality of radially disposed ducts 45 in fluid communication with radially disposed ports 46 in the disc 19 for supplying steam to the serially disposed cavities 25. To maintain a low pressure in the bore 42, improved seals are required at the radial periphery of the cavities 25.

Figure 7:
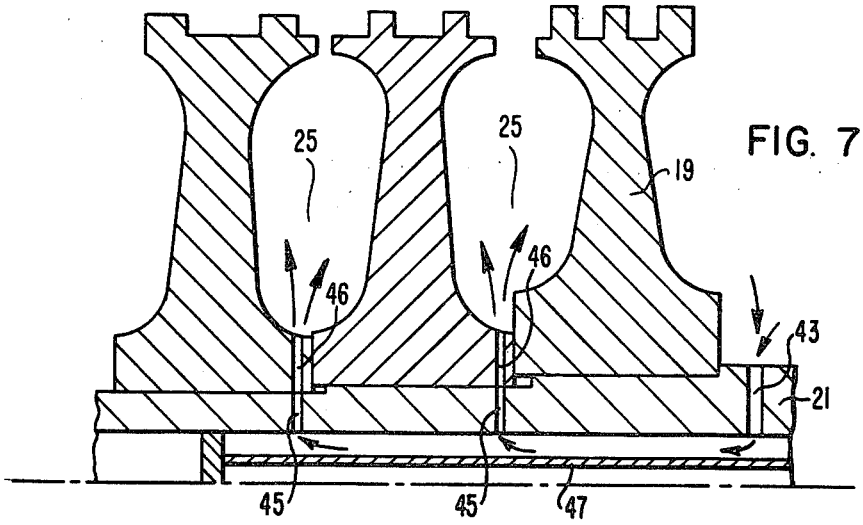

FIG. 7 is similar to FIG. 6 with the exception that a liner 47 is disposed within the bore 42 to increase the heat transferred from the bore 42 to the shaft 21.

Figure 8:
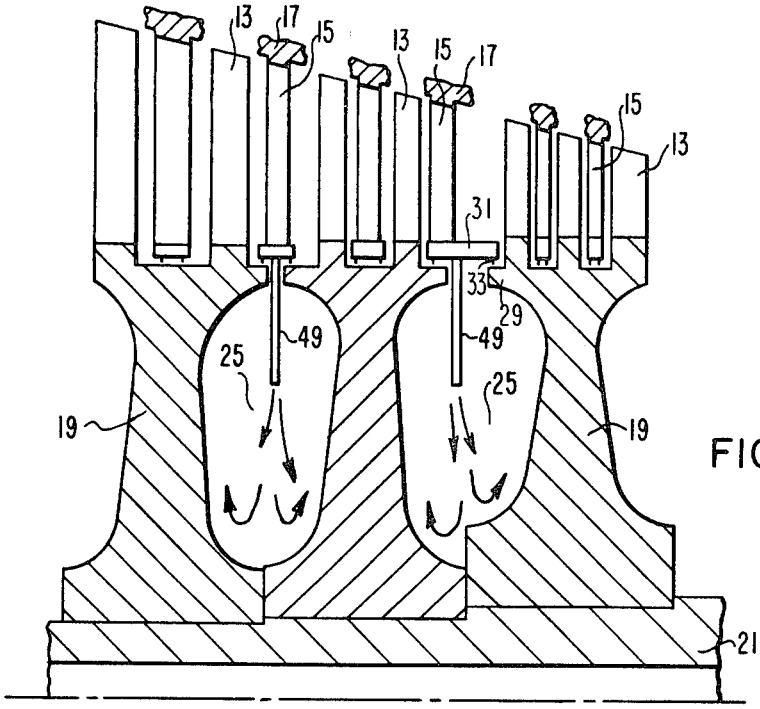

FIG. 8 shows conduits 49 which pass through the blade diaphragms 17 and into the cavities 25. Steam from the inlet or other source is fed through the conduits 49 to provide superheated steam at varying temperatures and pressures to the serially disposed cavities 25. Improved seals at the outer periphery of the cavities 25 allows a minimum amount of steam to be supplied to each cavity 25 to maintain steam in each cavity in a superheated condition.

Figure 9:
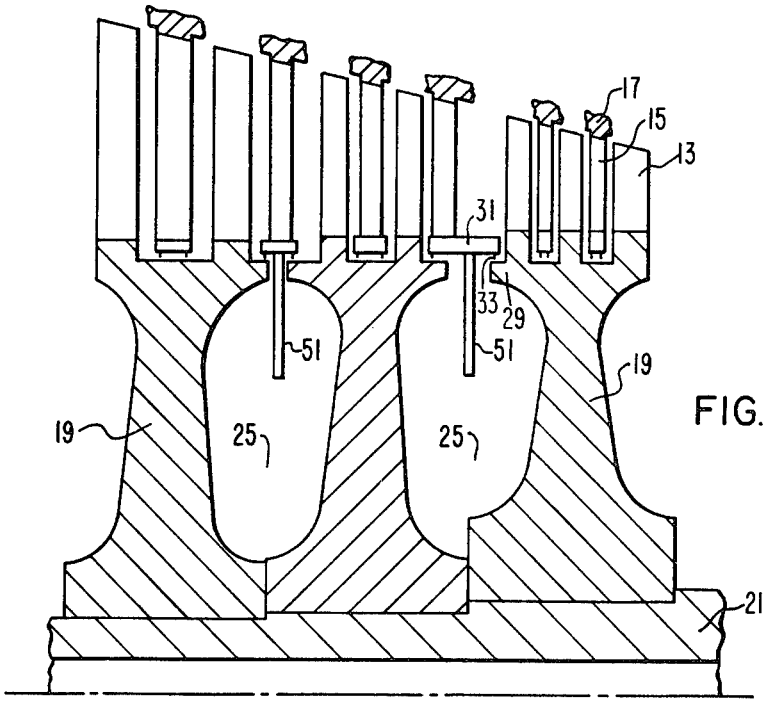

FIG. 9 shows blades 51 extending radially inwardly from the blade diaphragms 17 into the cavities 25. Windage caused by the steam rotating with the blade disc 19 and contacting the blades 51 increases the energy of the steam within the cavities 25 so that it is maintained in a superheated condition.

Hereinbefore are described various means for providing superheated steam at varying flow rates and/or pressures and temperatures to the cavities 25 serially idsposed between the blade discs 19, which cooperate with improved seals at the radially outer periphery of the cavities 25 to prevent the formation of moisture in the cavities 25 and to prevent stress corrosion in the blade discs 19.

What is claimed is:

1. A steam turbine comprising a shaft, a plurality of stationary blade rins, a plurality of rotor blade discs shrunk on said shaft in such a manner to form a cavity between adjacent discs so that a plurality of said cavities are disposed serially with respect to the steam flow from a high pressure to a low pressure portion of the turbine, means throttling the steam entering said cavities for providing superheated steam in said cavities and control leakage seals between said rotor blade discs and said stationary blade rings at a radially outward portion of said cavities, which cooperate with the means throttling the steam entering said cavities for providing superheated steam to maintain the superheated condition within the cavities to prevent stress corrosion cracking of the rotor blade discs initiating at the bore.

2. A steam turbine as set forth in claim 1 and further comprising stationary blade diaphragms cooperatively associated with said blade discs and low leakage seals comprising lands extending axially from the disc and labyrinth seals disposed between the lands and the blade diaphragms.

3. A steam turbine as set forth in claim 2 wherein the low leakage seals also comprise lands extending axially from the blade diaphragms.

4. A steam turbine as set forth in claim 1 wherein the means for supplying superheated steam to the cavity comprises a plurality of holes disposed in the disc radially outwardly from the shaft.

5. A steam turbine as set forth in claim 1, wherein the means for supplying superheated steam to the cavities comprises ducts extending from adjacent the blades into the cavities.

6. A steam turbine as set forth in claim 2, wherein the means for supplying superheated steam to the cavities comprises openings in roots which attach the rotating blades to the blade discs and added clearance in labyrinth seals disposed between the stationary blade diaphragm and the blade discs.

7. A steam turbine as set forth in claim 1, wherein the means for supplying superheated steam to the cavities comprises grooves in the shaft in fluid communication with conduits in the blade disc which are in fluid communication with the cavities.

8. A steam turbine as set forth in claim 1, wherein the means for providing superheated steam to the cavities comprises ducts in the shaft in fluid communication with ducts in the disc which are in fluid communication with the cavities.

9. A steam turbine as set forth in claim 2, wherein the means for providing superheated steam to the cavities comprises ducts passing through the stationary blade diaphragms in fluid communication with the cavity and with a supply of steam.

10. A steam turbine as set forth in claim 2, wherein the means for providing superheated steam to the cavities comprises blades extending inwardly from the stationary blade diaphragms into the cavities.

* * * * *